US009708906B2

(12) United States Patent
Flores et al.

(10) Patent No.: US 9,708,906 B2
(45) Date of Patent: Jul. 18, 2017

(54) METHOD AND SYSTEM FOR HYDRAULIC FRACTURE DIAGNOSIS WITH THE USE OF A COILED TUBING DUAL ISOLATION SERVICE TOOL

(71) Applicant: Baker Hughes Incorporated, Houston, TX (US)

(72) Inventors: Juan Carlos Flores, The Woodlands, TX (US); Elton Frost, Jr., Spring, TX (US); Terrence Quinn, The Woodlands, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 293 days.

(21) Appl. No.: 14/495,793

(22) Filed: Sep. 24, 2014

(65) Prior Publication Data

US 2016/0084078 A1 Mar. 24, 2016

(51) Int. Cl.
*E21B 49/00* (2006.01)

(52) U.S. Cl.
CPC ..... *E21B 49/008* (2013.01)

(58) Field of Classification Search
CPC ..... E21B 47/06; E21B 49/88; E21B 43/26
See application file for complete search history.

(56) References Cited

U.S. PATENT DOCUMENTS 4,962,815 A * 10/1990 Schultz ..... E21B 23/006 166/127
5,287,741 A * 2/1994 Schultz ..... E21B 49/088 166/250.17
5,435,395 A 7/1995 Connell
5,638,904 A 6/1997 Misselbrook et al.
5,743,334 A 4/1998 Nelson
6,325,146 B1 * 12/2001 Ringgenberg ..... E21B 21/002 166/186
7,059,407 B2 * 6/2006 Tolman ..... E21B 17/203 166/120
7,066,283 B2 6/2006 Livingstone
(Continued)

OTHER PUBLICATIONS

Korean Intellectual Property Office; International Searching Authority; International Search Report & Written Opinion for Application No. PCT/US2015/049230 dated Nov. 25, 2015.
(Continued)

*Primary Examiner* — Shane Bomar
(74) *Attorney, Agent, or Firm* — Parsons Behle & Latimer

(57) ABSTRACT

A hydraulic fracture diagnostic system for reservoir evaluation of a high angle wellbore includes coiled tubing that extends from the surface to a wellbore location. The system includes a sensor and a pump connected to the coiled tubing and a pump and sensor connected to an annulus between the coiled tubing and the wellbore casing. A tool having at least two packing elements and a port positioned between the packing elements is connected to the coiled tubing and is positioned adjacent a fracture. The packing elements isolate the fracture and the port is configured to provide communication with the isolated portion of the wellbore. A diagnostic method includes pumping a volume of fluid into the isolated portion of a wellbore and monitoring the pressure within the annulus via the coiled tubing. The tool may also be used in an openhole portion of a wellbore to diagnose the formation.

11 Claims, 9 Drawing Sheets

(56) References Cited

U.S. PATENT DOCUMENTS

| | | | | |
|---|---|---|---|---|
| 7,980,306 | B2 | 7/2011 | Lovell et al. | |
| 8,015,869 | B2 | 9/2011 | Nold, III et al. | |
| 8,210,257 | B2 * | 7/2012 | Dusterhoft | E21B 43/26 166/250.1 |
| 2003/0000707 | A1 * | 1/2003 | Flowers | E21B 47/187 166/374 |
| 2003/0037926 | A1 * | 2/2003 | Sask | E21B 21/16 166/279 |
| 2003/0084715 | A1 | 5/2003 | Zazovsky | |
| 2003/0196815 | A1 * | 10/2003 | Crawford | E21B 17/203 166/369 |
| 2003/0230408 | A1 | 12/2003 | Acock et al. | |
| 2006/0000620 | A1 | 1/2006 | Hamilton | |
| 2006/0248949 | A1 | 11/2006 | Gregory et al. | |
| 2007/0044960 | A1 * | 3/2007 | Lovell | E21B 17/206 166/250.07 |
| 2007/0062694 | A1 | 3/2007 | Ring et al. | |
| 2009/0037112 | A1 | 2/2009 | Soliman et al. | |
| 2009/0164128 | A1 * | 6/2009 | Tchakarov | E21B 49/10 702/11 |
| 2009/0234584 | A1 | 9/2009 | Casey et al. | |
| 2010/0206548 | A1 * | 8/2010 | Pisio | E21B 43/26 166/101 |
| 2010/0258304 | A1 * | 10/2010 | Hegeman | E21B 47/10 166/250.01 |
| 2011/0048122 | A1 | 3/2011 | Le Foll et al. | |
| 2011/0073210 | A1 * | 3/2011 | Stretch | E21B 47/01 138/177 |
| 2011/0120702 | A1 | 5/2011 | Craig | |
| 2013/0118751 | A1 | 5/2013 | Landsiedel | |
| 2013/0180722 | A1 | 7/2013 | Olarte Caro et al. | |
| 2014/0238663 | A1 | 8/2014 | Neuwoudt et al. | |
| 2015/0075777 | A1 * | 3/2015 | Walters | E21B 49/008 166/250.1 |
| 2015/0075783 | A1 * | 3/2015 | Angman | E21B 43/26 166/250.01 |
| 2015/0167442 | A1 * | 6/2015 | Harfoushian | E21B 43/267 166/264 |
| 2016/0084056 | A1 * | 3/2016 | Flores | E21B 43/26 166/250.01 |

OTHER PUBLICATIONS

Alain C. Gringarten, Resevoir Limit Testing for Fractured Wells, Oct. 1-3, 1978, Oct. 1, 1978.

Herber Cinco-Ley & Fernando Samaniego-V, Transient Pressure Analysis for Fractured Well, Journal of Petroleum Technology, Sep. 1981, Jun. 4, 1979.

W.J. Lee & S.A. Holditch, SPE 7929 Fracture Evaluation With Pressure Transient Testing in Low-Permeability Gas Reservoirs. Part I: Theoretical Background, May 20, 1979.

Dominique Bourdet and Alain C. Gringarten, SPE 9293 Determination of Fissure Volume and Block Size in Fractured Reservoirs by Type-Curve Analysis Sep. 21, 1980.

International Bureau of WIPO; International Preliminary Report on Patentability; International Application No. PCT/US2015/049202; Mar. 30, 2017.

US Patent and Trademark Office; Office Action issued in U.S. Appl. No. 14/490,289 dated May 11, 2017.

* cited by examiner

METHOD AND SYSTEM FOR HYDRAULIC FRACTURE DIAGNOSIS WITH THE USE OF A COILED TUBING DUAL ISOLATION SERVICE TOOL

BACKGROUND

Field of the Disclosure

The embodiments described herein relate to a system and method for evaluating a production zone of a wellbore. The production zone is isolated by two isolating elements and a diagnostic of the formation and/or fracture may be done using coiled tubing in communication with the isolated production zone.

Description of the Related Art

Natural resources such as gas and oil may be recovered from subterranean formations using well-known techniques. For example, a horizontal wellbore, also referred to as a high angle well, may be drilled within the subterranean formation. After formation of the high angle wellbore, a string of pipe, e.g., casing, may be run or cemented into the wellbore. Hydrocarbons may then be produced from the high angle wellbore.

In an attempt to increase the production of hydrocarbons from the wellbore, the casing is perforated and fracturing fluid is pumped into the wellbore to fracture the subterranean formation. Hydraulic fracturing of a wellbore has been used for more than 60 years to increase the flow capacity of hydrocarbons from a wellbore. Hydraulic fracturing pumps fluids into the wellbore at high pressures and pumping rates so that the rock formation of the wellbore fails and forms a fracture to increase the hydrocarbon production from the formation by providing additional pathways through which reservoir fluids being produced can flow into the wellbore. An analysis of the near wellbore pressure may provide diagnostic information about the fracture, formation, and/or reservoir of hydrocarbons within the formation.

A production zone within a wellbore may have been previously fractured, but the prior hydraulic fracturing treatment may not have adequately stimulated the formation leading to insufficient production results. Even if the formation was adequately fractured, the production zone may no longer be producing at desired levels. Over an extended period of time, the production from a previously fractured high angle multizone wellbore may decrease below a minimum threshold level. The wellbore may be re-fractured in an attempt to increase the hydrocarbon production. An analysis of the near wellbore pressure before, during, and/or after the re-fracturing process may provide diagnostic information about the fracture, formation, and/or reservoir of hydrocarbons within the formation, or any wells in communication with the wellbore. Current diagnostic testing of high angle wellbores is limited to electrically conductive wire threaded in coiled tubing. It may be desirable to provide a tool and method of using pressure sensors and/or other sensors to provide diagnostic information about a high angle wellbore and the formation through which it traverses.

SUMMARY

The present disclosure is directed to a tool and method for obtaining diagnostic information about a fracture, formation, and/or reservoir of hydrocarbons and overcomes some of the problems and disadvantages discussed above.

One embodiment is a hydraulic fracture diagnostic system for well reservoir evaluation of a high angle wellbore comprising a coiled tubing string extending from a surface location to a downhole location within a wellbore. The system comprises at least one sensor connected to a portion of the coiled tubing string and at least one pump connected to the coiled tubing string. The system comprises at least one sensor connected to an annulus between the coiled tubing string and a casing of the wellbore and a downhole tool connected to the coiled tubing string being positioned adjacent a hydraulic fracture in a formation traversed by the wellbore. The downhole tool comprises a first packing element and a second packing element that may be actuated to isolate the hydraulic fracture. The downhole tool comprises a port positioned between the first packing element and the second packing element, the port configured to provide communication to an exterior of the downhole tool with an interior of the coiled tubing string.

The sensor connected to the coiled tubing string and the sensor connected to the annulus may be pressure sensors. The pressure sensors may be located at the surface. The system may include at least one processor configured to determine at least one characteristic of the formation of the wellbore based on measurements from the pressure sensors.

One embodiment is a diagnostic method comprising running a tool on coiled tubing into a wellbore, the tool having at least two isolation elements and setting the at least two isolation elements against casing to isolate a first portion of the wellbore. The method comprises pumping fluid into an annulus between the coiled tubing and the casing to create an increase in pressure and monitoring a pressure within the isolated first portion of the wellbore via the coiled tubing. The method comprises recording a change in pressure and time until the pressure within the coiled tubing is stabilized.

The method may include determining at least one characteristic of a formation traversed by the wellbore from monitoring the pressure. The method may include unsetting the at least two isolating elements and moving the tool via the coiled tubing to a second location within the wellbore. The method may include conducting additional diagnostic testing on the first portion of the wellbore. The method may include determining additional characteristics of the formation traversed by the wellbore from the additional diagnostic testing on the first portion of the wellbore. The method may include fracturing the formation adjacent the first portion of the wellbore. The additional diagnostic testing may include pumping fluid from the isolated first portion of the wellbore via the coiled tubing and monitoring a pressure in the coiled tubing. The additional diagnostic testing may include injecting fluid into the isolated first portion of the wellbore via the coiled tubing and monitoring the pressure in the coiled tubing.

One embodiment is a diagnostic method comprising running a tool on coiled tubing into a wellbore, the tool having at least two isolation elements and setting the at least two isolation elements against a casing to isolated a first portion of the wellbore. The method comprises pumping fluid into the isolated first portion of the wellbore and monitoring a pressure within an annulus between the coiled tubing and the casing. The method comprises recording a change in pressure and time until the pressure within the annulus is stabilized.

The method may include determining at least one characteristic of a formation traversed by the wellbore from monitoring the pressure. The method may include unsetting the at least two isolation elements and moving the tool via the coiled tubing to a second location within the wellbore. The method may include conducting additional diagnostic testing on the first portion of the wellbore. The method may include determining additional characteristics of the formation traversed by the wellbore from the additional diagnostic testing on the first portion of the wellbore. The method may include fracturing the formation adjacent the first portion of the wellbore. The additional diagnostic testing may include pumping fluid from the isolated first portion of the wellbore via the coiled tubing and monitoring a pressure in the coiled tubing.

One embodiment is a diagnostic method of an openhole portion of a high angle wellbore comprising running a tool from a surface location to an openhole location in a high angle wellbore, the tool being connected to a coiled tubing string and comprising at least two packing elements and a port between the two packing elements, the port in communication with an interior of the coiled tubing string. The method comprises setting the at least two packing element to hydraulically isolate a portion of the openhole location of the high angle wellbore and filling and pressurizing the interior of the coiled tubing string with a fluid having a known density. The method comprises monitoring a pressure within the interior of the coiled tubing string.

Figure 1:
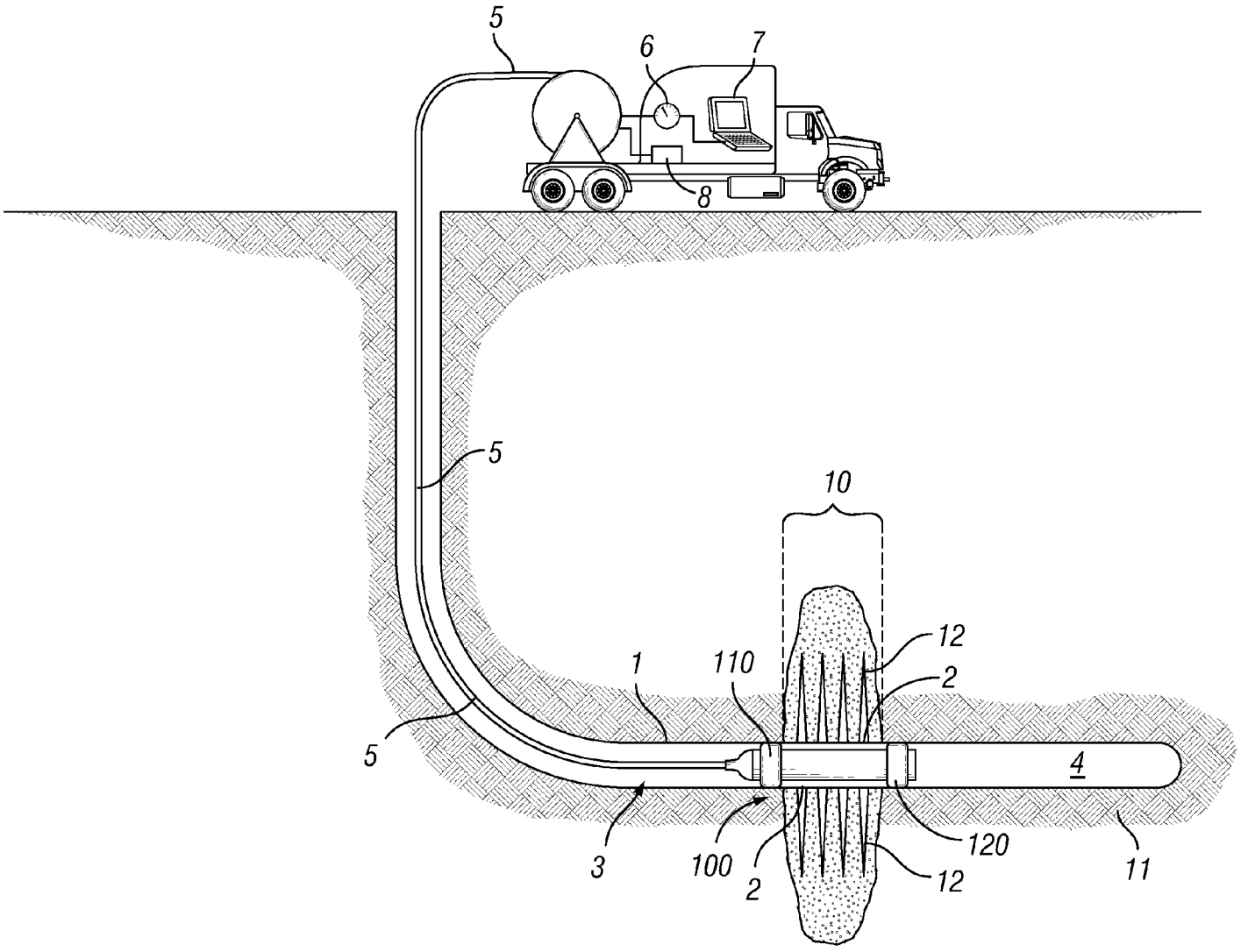
FIG. 1 shows an embodiment of a system that may be used for hydraulic fracture diagnostics.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the invention as defined by the appended claims.

DETAILED DESCRIPTION

FIG. 1 shows a downhole isolation tool 100 connected to a coiled tubing string 5, hereinafter referred to as coiled tubing, positioned within casing 1 of a horizontal or high angle wellbore, herein after referred to as a high angle wellbore. Coiled tubing 5 may be used to position the tool 100 within the high angle wellbore at a desired location as opposed to wireline, which cannot be used to position a tool within a high angle wellbore as would be appreciated by one of ordinary skill in the art. The tool 100 includes a first isolating element 110 and a second isolating element 120 that are actuated to isolate a first production zone 10 of the wellbore from the portion 4 of the wellbore downhole of the tool 100 and from the portion 3 of the wellbore uphole of the tool 100. The first production zone 10 may include at least one perforation 2 in the casing 1 and may include a plurality of perforations 2 in the casing 1 as shown in FIG. 1. The formation 11 may have been fractured 12 adjacent to the perforations within the production zone 10 as shown in FIG. 1. The number, size, and configuration of the fractures 12 and perforations 2 of a production zone may vary as would be appreciated by one of ordinary skill in the art.

Once a production zone 10 is isolated by the tool 100 from the rest of the wellbore, the coiled tubing 5 may be used for various diagnostic tests to determine various characteristics of the formation 11, fractures 12, and/or reservoir within the formation 11. The tool 100 includes a port 131 (shown in FIG. 2) located between the isolation elements 110 and 120 that permits fluid communication between the coiled tubing 5 and the isolated production zone 10. The coiled tubing 5 and tool 100 provide a hydraulic connection from the formation reservoir with the surface via port 131 in the tool 100. A pressure sensor 6 located at the surface may be used to monitor the pressure within the interior of the coiled tubing 5. The pressure sensor 6 may be connected to a computing device or any processor-based device 7 that may be used to analyze the pressure measurements and determine various characteristics of the formation 11, fractures 12, and/or reservoir within the formation 11. The pressure data from the pressure sensor 6 may be wirelessly transmitted to a processor-based device 7 located onsite or at a different location. The pressure data from the pressure sensor 6 may also be stored and/or record to be analyzed at a later date and/or at a different location. The pressure sensor 6 may be located within the wellbore and the data measured by the pressure sensor 6 may be recorded in memory for post operation analysis.

The change in pressure over time during various diagnostic tests may be used to determine various characteristics of the wellbore. For example, the tool 100 and coiled tubing 5 connected to a pump 8 and pressure sensor 6 may provide information about different flow regimes of the reservoir. It is generally understood by one of ordinary skill in the art that a hydraulically fractured producing well has at least three dominant flow regimes. One flow regime is the initial radial flow which is driven by the quasi-infinite conductivity and volume created artificially by the fracture. The initial radial flow regime may represent the volume created by the fracture to the stimulated permeability of the formation. Another flow regime is the linear flow driven by intrinsic permeability of the reservoir reaching through the fracture surface with the reservoir volume until it reaches the pressure front from an adjacent fracture. Yet another flow regime is the flow when the pressure drop disturbance reaches the top and bottom boundaries of the reservoir.

A transient pressure analysis of the near wellbore pressure of the isolated production zone 10 can potentially provide information on the characteristics of a stimulated reservoir volume in a short period of time. The coiled tubing 5 and port 131 in the downhole tool 100 provide a conduit from the surface to determine the transient near wellbore pressure. An analysis of the transient pressure analysis may provide reservoir and boundary information. A transient pressure analysis using an isolation tool 100 connected to coiled tubing 5, also referred to as the disclosed system, may be used for pre-fracture diagnostics, monitoring the reservoir during a fracturing or re-fracturing process, and/or monitoring the reservoir for a post fracture, or re-fracturing, evaluation. Monitoring the near wellbore pressure using the disclosed system may identify any skin factor on a fracture. During a re-fracture operation, the disclosed system may help to diagnose if a decline in production is mainly due to reservoir depletion of whether the decline in production is due to reduced conductivity by closing of the fracture, fine filling, formation damage, etc. The disclosed system may help re-fracture for previously fractured location to stimulate the fracture by increasing conductivity, increasing fracture length, increasing fracture width, and/or opening a new fracture in an undisturbed formation.

The downhole isolation tool 100 includes a first isolation element 110 and a second isolation element 120 that may be actuated to selectively isolate a portion of wellbore from the rest of the wellbore. A port 131 in the tool 100 permits fluid communication from the surface to the isolated portion of the wellbore via coiled tubing 5. Once the tool 100 is positioned at a desired location within the wellbore, the coiled tubing 5 may be filled with a diagnostic fluid. The diagnostic fluid may be a fluid having a specified density. Fluid contained within the coiled tubing 5 may need to be displaced out of the coiled tubing 5 upon filling the coiled tubing 5 with the diagnostic fluid. The coiled tubing 5 may convey the tool 100 into the wellbore with the diagnostic fluid already within the interior of the coiled tubing string. Since the properties of the diagnostic fluid are known, the diagnostic fluid may be used to determine properties of the wellbore, such as production flow rate from a fracture or fracture cluster, as described herein.

Figure 2:
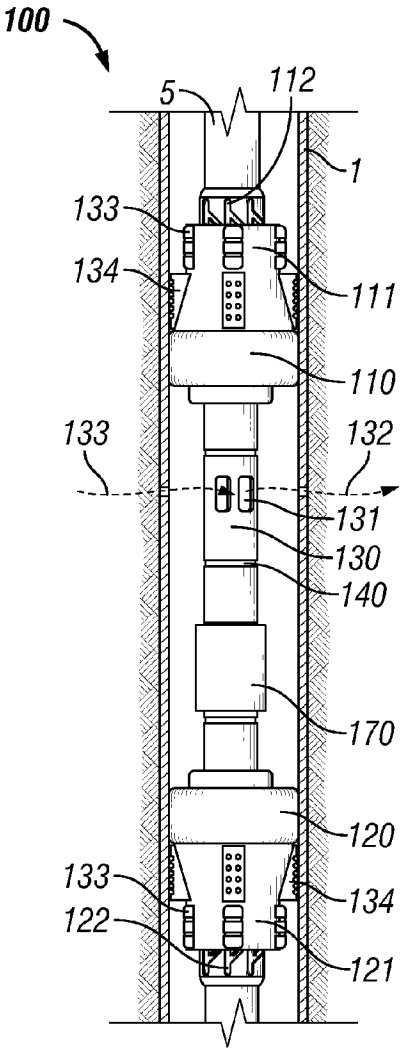
FIG. 2 shows an embodiment of a dual isolation tool that may be used for hydraulic fracture diagnostics.

The downhole isolation tool 100 may be one of various tools that allow for a portion of a wellbore to be isolate while permitting communication between the surface and the isolated wellbore. FIG. 2 shows an embodiment of the downhole tool 100 comprising one embodiment of a tool disclosed in U.S. patent application Ser. No. 14/318,952 entitled Synchronic Dual Packer filed on Jun. 30, 2014, which is incorporated by reference in its entirety. The isolation tool 100 may include pressure sensors as disclosed in U.S. patent application Ser. No. 14/318,952. The downhole pressure sensors may store pressure readings in memory to be analyzed after the tool 100 is removed from the wellbore. Alternatively, the downhole pressure sensors may transmit the pressure readings to the surface to be analyzed as discussed herein.

FIG. 2 shows an embodiment of a downhole isolation tool 100 having a first packing element 110 and a second packing element 120. The first packing element 110 may be an upper packer and the second packing element 120 may be a lower packer. The first and second packing elements 110 and 120 may each comprise a plurality of packing elements configured to create a seal between the tool 100 and casing 1, or tubing, of a wellbore. The downhole tool 100 is conveyed into the wellbore via a work string 5 and positioned at a desired location within the wellbore. The tool 100 includes a ported sub 130 having one or more flow ports 131 and a quick disconnect sub 140.

The second packing element 120 may be set in compression by the rotation of a sleeve or rotating sub 121 connected to the second packing element 120. The rotation of the sleeve or rotating sub 121 moves an element along a j-slot track 122 that actuates the second packing element between a set and unset state. The first packing element 110 may be set in tension by the rotation of a sleeve or rotating sub 111 connected to the first packing element 110. The rotation of the sleeve or rotating sub 111 moves an element along a j-slot track 112 that actuates the first packing element between a set and unset state as described herein. The downhole tool 100 may include a slip joint 170 positioned between the upper and lower packing elements 110 and 120. The slip joint 170 permits the lengthening of the distance between the lower packing element 120 and the upper packing element 110 while the upper packing element 110 is being set within the wellbore. The lengthening of the distance between the packing elements 110 and 120 may aid in preventing the lower packing element 120 from becoming unset during the setting of the upper packing element 110.

The setting of the first and second packing elements 110 and 120 hydraulically isolates the portion of the wellbore between the packing elements 110 and 120 from the rest of the wellbore. The downhole tool 100 may include drag blocks 133 and slips 134 to help retain the packing elements 110 and 120 in a set state within the casing 1.

The pump 8 at the surface may pump fluid down the coiled tubing 5 and out of the flow ports 131 of the ported sub 130 as shown by arrow 132 in FIG. 2. Likewise, fluid may be pumped out of the coiled tubing at the surface via pump 8 and fluid will flow from the formation and into the flow ports 131 of the ported sub 130 as shown by arrow 133. This permits the diagnostic testing and/or treatment of the fractures, formation, and reservoir as discussed herein. After a portion of the wellbore has been diagnosed and/or treated, the packing elements 110 and 120 may be unset and the tool 100 may be moved to another location within the wellbore.

Figure 3:
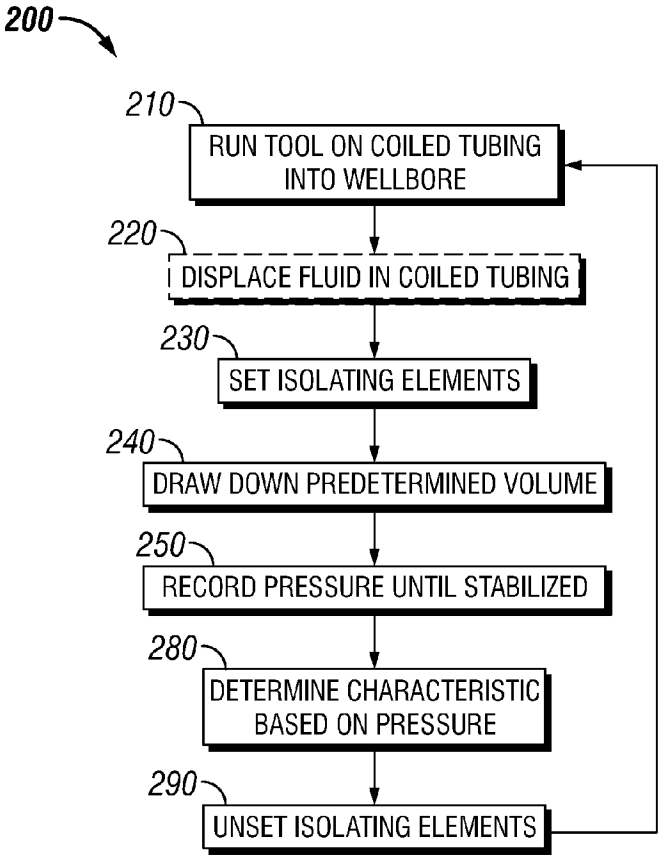
FIG. 3 shows a flow chart of an embodiment of a drawdown diagnostic method.

FIG. 3 shows a flow chart of one diagnostic method 200 using a dual isolation tool 100 to isolate a portion of a wellbore. In step 210 of method 200, an isolation tool is run into a high angle wellbore using coiled tubing 5. The coiled tubing 5 is used to locate the tool 100 adjacent a portion of the high angle wellbore, such as a production zone 10, that is to be isolated so that diagnostic testing can be performed. In optional step 220 of method 200, the fluid in the coiled tubing 5 is displaced with a diagnostic fluid having a known density. An example of a diagnostic fluid is fresh water having a density of 8.34 lbs/gallon. However, any fluid with a known density may be used as a diagnostic fluid as would be recognized by one of ordinary skill in the art having the benefit of this disclosure. Step 220 is optional as the diagnostic fluid may already be contained in the coiled tubing 5 while the tool 100 is run into the high angle wellbore.

The isolating elements 110 and 120 of the tool 100 are then set to isolate a portion of the high angle wellbore in step 230 of method 200. A predetermined volume of diagnostic fluid may then be removed from the coiled tubing 5 via the surface pump 8 in step 240. In the draw down step 240, a volume of fluid is being removed from the isolated wellbore by being pumped into the interior of the coiled tubing 5. A corresponding amount of volume of fluid will be removed from the coiled tubing at the surface. In step 250 of method 200, the transient fluid pressure in the coiled tubing 5 will then be monitored and recorded over time until the pressure has stabilized. In step 280, the transient pressures during the draw down step may be plotted over time using a computing device 7 to determine various properties of the wellbore such as fracture length, fracture width, production pressure of the reservoir, and the amount of fluid within the reservoir. After the diagnostic testing, the isolating elements are unset in step 290 and the tool 100 may be moved to another location within the high angle wellbore via the coiled tubing 5.

Figure 4:
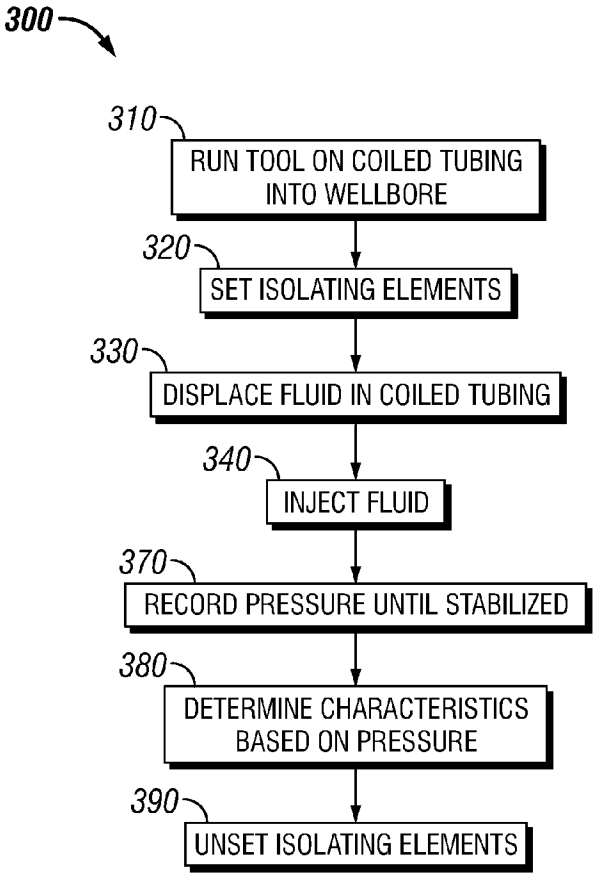
FIG. 4 shows a flow chart of an embodiment of an injectivity diagnostic method.

FIG. 4 shows a flow chart of one diagnostic method 300 using a dual isolation tool 100 to isolation a portion of a wellbore to evaluate the formation during a fracturing or re-fracturing operation. In step 310 of method 300, an isolation tool 100 is run into a high angle wellbore using coiled tubing 5. The coiled tubing 5 is used to locate the tool 100 adjacent a production zone 10 that is to be isolated so that diagnostic testing can be performed. The isolating elements 110 and 120 of the tool 100 are then set to isolate a portion of the high angle wellbore in step 320 of method 300. In step 330 of method 300, the fluid in the coiled tubing 5 is displaced with a diagnostic fluid having a known density. A predetermined volume of fluid is then injected into the isolated production zone by pumping fluid down the coiled tubing 5 via the surface pump 8 in step 340. In step 370, the fluid pressure in the coiled tubing 5 will then be monitored and recorded until the pressure within the interior of the coiled tubing string is stabilized. In step 380, the transient pressures may be plotted over time to determine various properties of the wellbore such as fracture length, fracture width, production pressure of the reservoir, and the amount of fluid within the reservoir. After the diagnostic testing, the isolating elements are unset in step 390 and the tool 100 may be moved to another location within the high angle wellbore via the coiled tubing 5.

Figure 5:
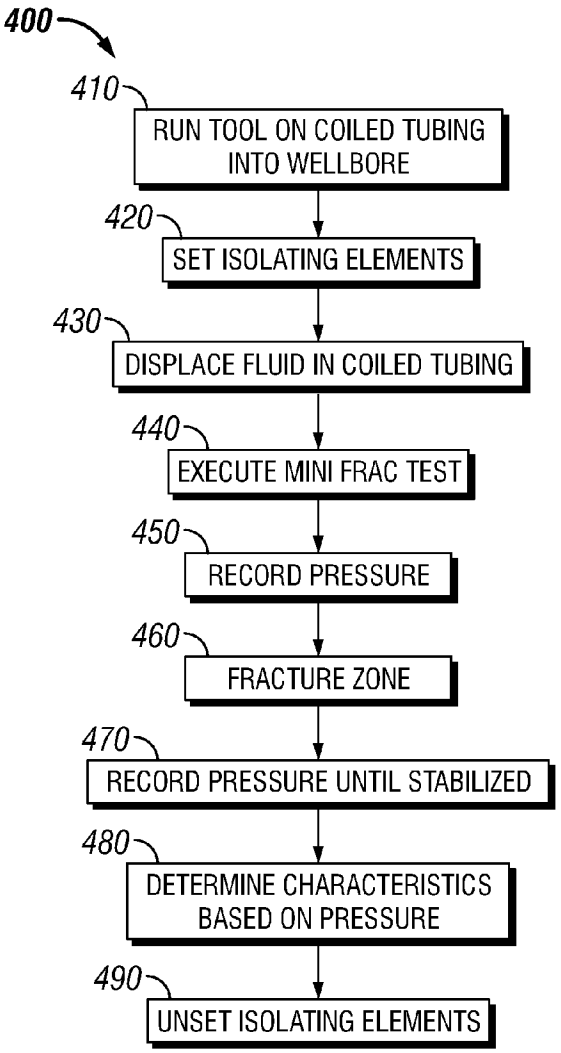
FIG. 5 shows a flow chart of an embodiment of a re-fracture with min-frac diagnostic method.

FIG. 5 shows a flow chart of one diagnostic method 400 using a dual isolation tool 100 to isolation a portion of a wellbore to evaluate the formation during a fracturing or re-fracturing operation. In step 410 of method 400, an isolation tool 100 is run into a high angle wellbore using coiled tubing 5. The coiled tubing 5 is used to locate the tool 100 adjacent a production zone 10 that is to be isolated so that diagnostic testing can be performed. The isolating elements 110 and 120 of the tool 100 are then set to isolate a portion of the high angle wellbore in step 420 of method 300. In step 430 of method 400, the fluid in the coiled tubing 5 is displaced with a diagnostic fluid having a known density. A "mini frac test" may then be performed by pumping fluid down the coiled tubing 5 via the surface pump 8 in step 440. A "mini frac test", as used herein, is the injection of the amount of fracturing fluid, without any proppant, in the amount of fluid that is just enough to open a fracture in the formation and measure the initial pressure required to open the fracture. In step 450 of method 400, the fluid pressure in the coiled tubing 5 is monitored and recorded during the "mini frac test" of step 440. The formation may then be fractured, or re-fractured if the location has been previously hydraulically fractured, during step 460 of method 400. In step 470, the fluid pressure in the coiled tubing 5 will be monitored and recorded during the fracturing procedure of step 460 until the pressure is stabilized. In step 480, the transient pressures during the "mini frac test" and the fracturing, or re-fracturing, operation may be plotted over time to determine various properties of the wellbore such as fracture length, fracture width, production pressure of the reservoir, and the amount of fluid within the reservoir. After the diagnostic testing, the isolating elements are unset in step 490 and the tool 100 may be moved to another location within the high angle wellbore via the coiled tubing 5.

Figure 6:
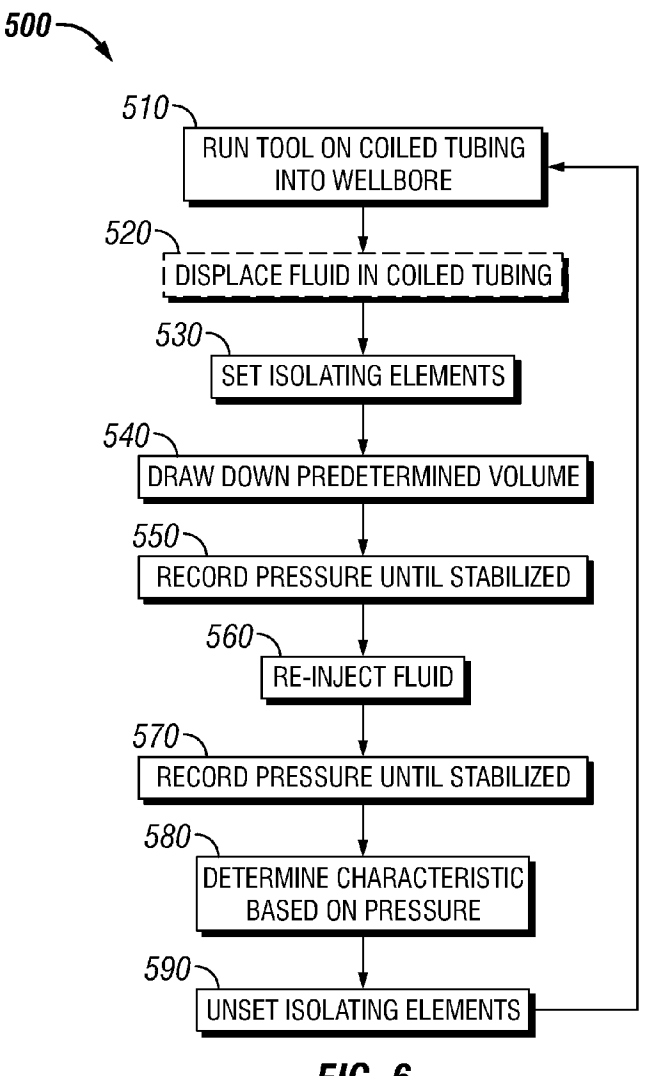
FIG. 6 shows a flow chart of an embodiment of a drawdown and injectivity diagnostic method.

FIG. 6 shows a flow chart of one diagnostic method 500 using a dual isolation tool 100 to isolate a portion of a wellbore. In step 510 of method 500, an isolation tool 100 is run into a high angle wellbore using coiled tubing 5. The coiled tubing 5 is used to locate the tool 100 adjacent a portion of the high angle wellbore, such as a production zone 10, that is to be isolated so that diagnostic testing can be performed. In optional step 520 of method 500, the fluid in the coiled tubing 5 is displaced with a diagnostic fluid having a known density. An example of a diagnostic fluid is fresh water having a density of 8.34 lbs/gallon. However, any fluid with a known density may be used as a diagnostic fluid as would be recognized by one of ordinary skill in the art having the benefit of this disclosure. Step 520 is optional as the diagnostic fluid may already be contained in the coiled tubing 5 while the tool 100 is run into the high angle wellbore.

The isolating elements 110 and 120 of the tool 100 are then set to isolate a portion of the high angle wellbore in step 530 of method 500. A predetermined volume of diagnostic fluid may then be removed from isolated portion of the high angle wellbore via the coiled tubing 5 and the surface pump 8 in draw down step 540. In step 550 of method 500, the transient fluid pressure within the interior of the coiled tubing 5 will then be monitored and recorded over time until the pressure has stabilized. The predetermined volume of diagnostic fluid will then be re-injected into the isolated portion of the wellbore via the coiled tubing 5 and surface pump 8 in step 560 and in step 570 the transient fluid pressure within the interior of the coiled tubing 5 will then be monitored and recorded over time until the pressure has stabilized. In step 580, the transient pressures during the draw down and re-injection steps may be plotted over time using a computing device 7 to determine various properties of the wellbore such as fracture length, fracture width, production pressure of the reservoir, and the amount of fluid within the reservoir. After the diagnostic testing, the isolating elements are unset in step 590 and the tool 100 may be moved to another location within the high angle wellbore via the coiled tubing 5.

Figure 7:
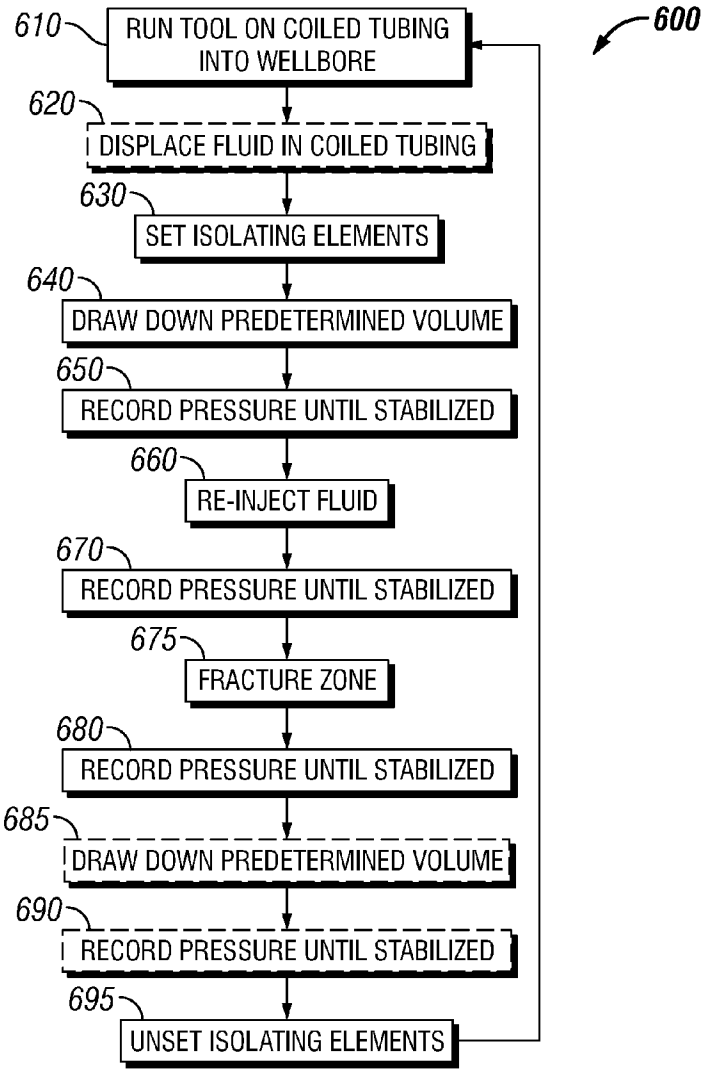
FIG. 7 shows a flow chart of an embodiment of a drawdown, injectivity, and re-fracture diagnostic method.

FIG. 7 shows a flow chart of one diagnostic method 600 using a dual isolation tool 100 to isolate a portion of a wellbore to evaluate the formation during a fracturing or re-fracturing operation. In step 610 of method 600, an isolation tool 100 is run into a high angle wellbore using coiled tubing 5. The coiled tubing 5 is used to locate the tool 100 adjacent a production zone 10 that is to be isolated so that diagnostic testing can be performed. In step 620 of method 600, the fluid in the coiled tubing 5 may be displaced with a diagnostic fluid having a known density. The step 620 of displacing the fluid with a diagnostic fluid is optional as the interior of the coiled tubing 5 may already be filled with a fluid having a known density. The isolating elements 110 and 120 of the tool 100 are then set to isolate a portion of the high angle wellbore in step 630 of method 600. A predetermined volume of diagnostic fluid may then be removed from isolated portion of the high angle wellbore via the coiled tubing 5 and the surface pump 8 in draw down step 640. In step 650 of method 600, the transient fluid pressure within the interior of the coiled tubing 5 will then be monitored and recorded over time until the pressure has stabilized.

A volume of fluid may then be re-injected into the isolated portion of the wellbore via the coiled tubing 8 and the surface pump in step 660. The re-injection of fluid may be a "mini frac test." In step 670 of method 600, the fluid pressure within the coiled tubing 5 is monitored and recorded during the re-injection step 660 until the pressure within the coiled tubing 5 has stabilized. The formation may then be fractured, or re-fracture if the location has been previously hydraulically fractured, during step 675 of method 600. In step 675, the fluid pressure within the coiled tubing 5 will be monitored and recorded during the fracturing procedure of step 660 until the pressure within the coiled tubing 5 has stabilized. Optionally, a second draw down step 685 may be done after the fracturing step 680 that pumps a determined volume of fluid from the isolated portion of the wellbore and the transient pressure within the coiled tubing may be monitored and recorded until the pressure stabilizes in optional step 690. The transient pressures within the coiled tubing during diagnostic testing may be plotted over time to determine various properties of the wellbore such as fracture length, fracture width, production pressure of the reservoir, and the amount of fluid within the reservoir. After the diagnostic testing, the isolating elements are unset in step 695 and the tool 100 may be moved to another location within the high angle wellbore via the coiled tubing 5.

Figure 8:
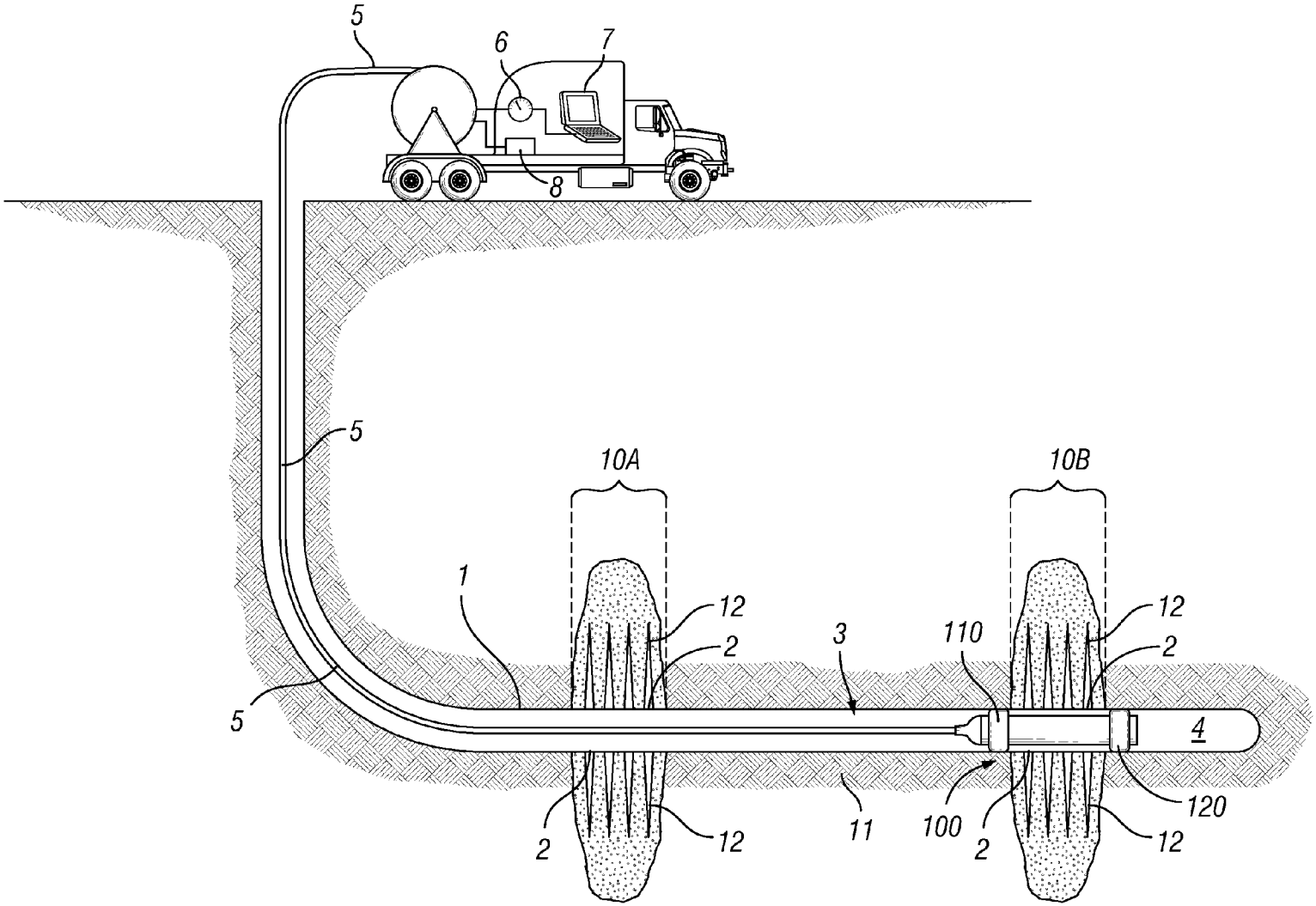
FIG. 8 shows an embodiment of a system that may be used for hydraulic fracture diagnostics.

FIG. 8 shows a downhole isolation tool 100 connected to coiled tubing 5 that has been positioned within casing 1 of a high angle wellbore adjacent a second production zone 10B. The downhole isolation tool 100 may have been moved to the second production zone 10B after diagnostic testing have been previously conducted on a first product zone 10A. The isolation elements 110 and 120 may be repeatedly actuated and deactivated so multiple locations along the length of a high angle wellbore may be isolated in sequence to permit diagnostic testing along a multizone high angle wellbore.

Figure 9:
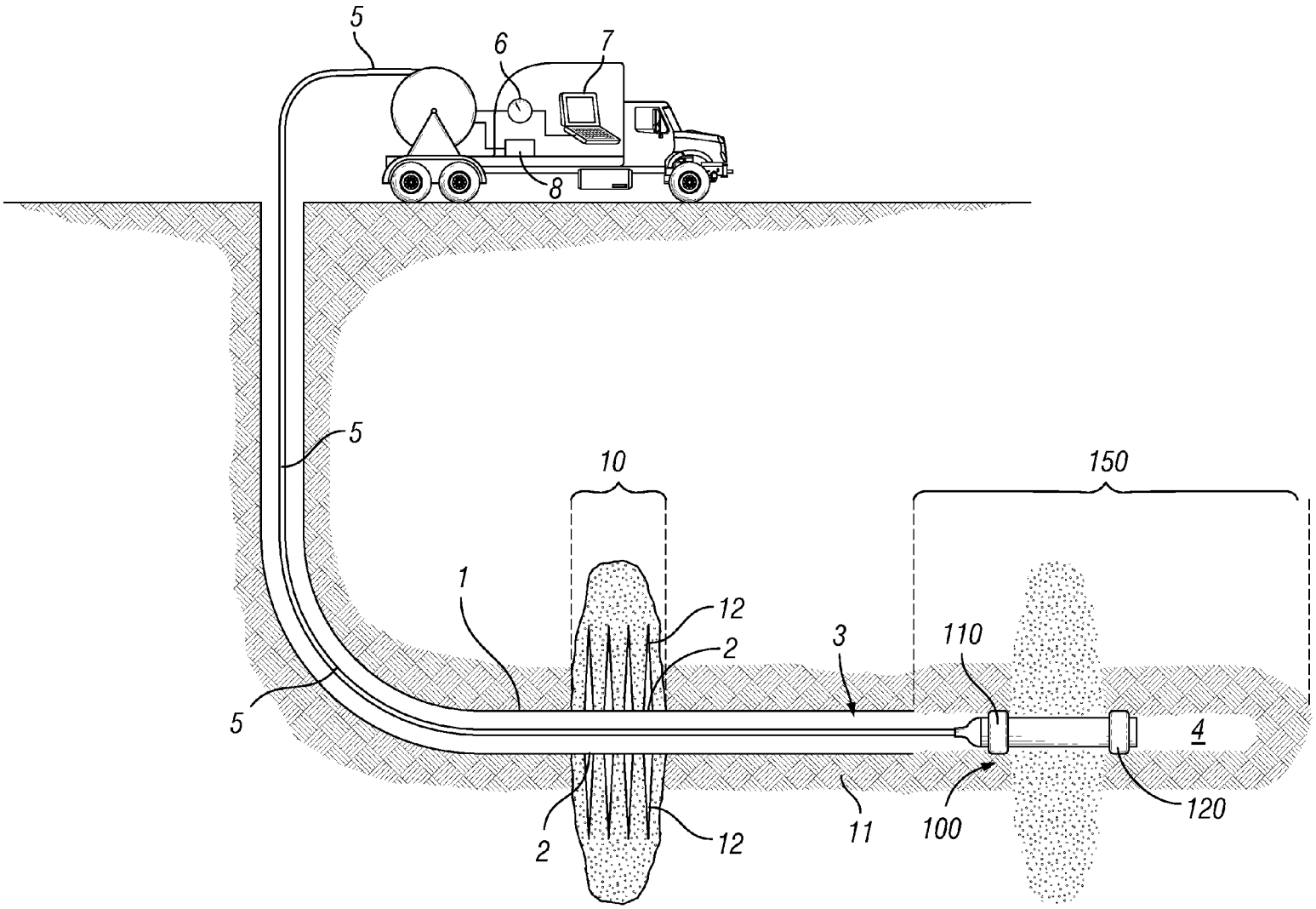
FIG. 9 shows an embodiment of a system that may be used for open hole diagnostics.

FIG. 9 shows a downhole isolation tool 100 connected to coiled tubing 5 that has been positioned within an openhole portion 150 of a high angle wellbore. The packing elements 110 and 120 of the downhole isolation tool 100 may have been actuated to seal a portion of the openhole portion 150 from the wellbore above 3 and below 4 the tool 100. The isolation elements 110 and 120 may be repeatedly actuated and deactivated so multiple locations along the length of a high angle wellbore may be isolated in sequence to permit diagnostic testing along a multizone high angle wellbore. The use of the isolation tool 100 in an openhole wellbore 150 may permit diagnostic testing of leak off to the formation. The interior of the coiled tubing 5 may be filled with a fluid having a known density and the pressure and amount of fluid monitored after the tool 100 has isolated a section of the openhole 150 wellbore. The monitoring of the transient pressure and/or amount of fluid loss from the interior of the coiled tubing over time may permit a determination of leak off to the formation.

Figure 10:
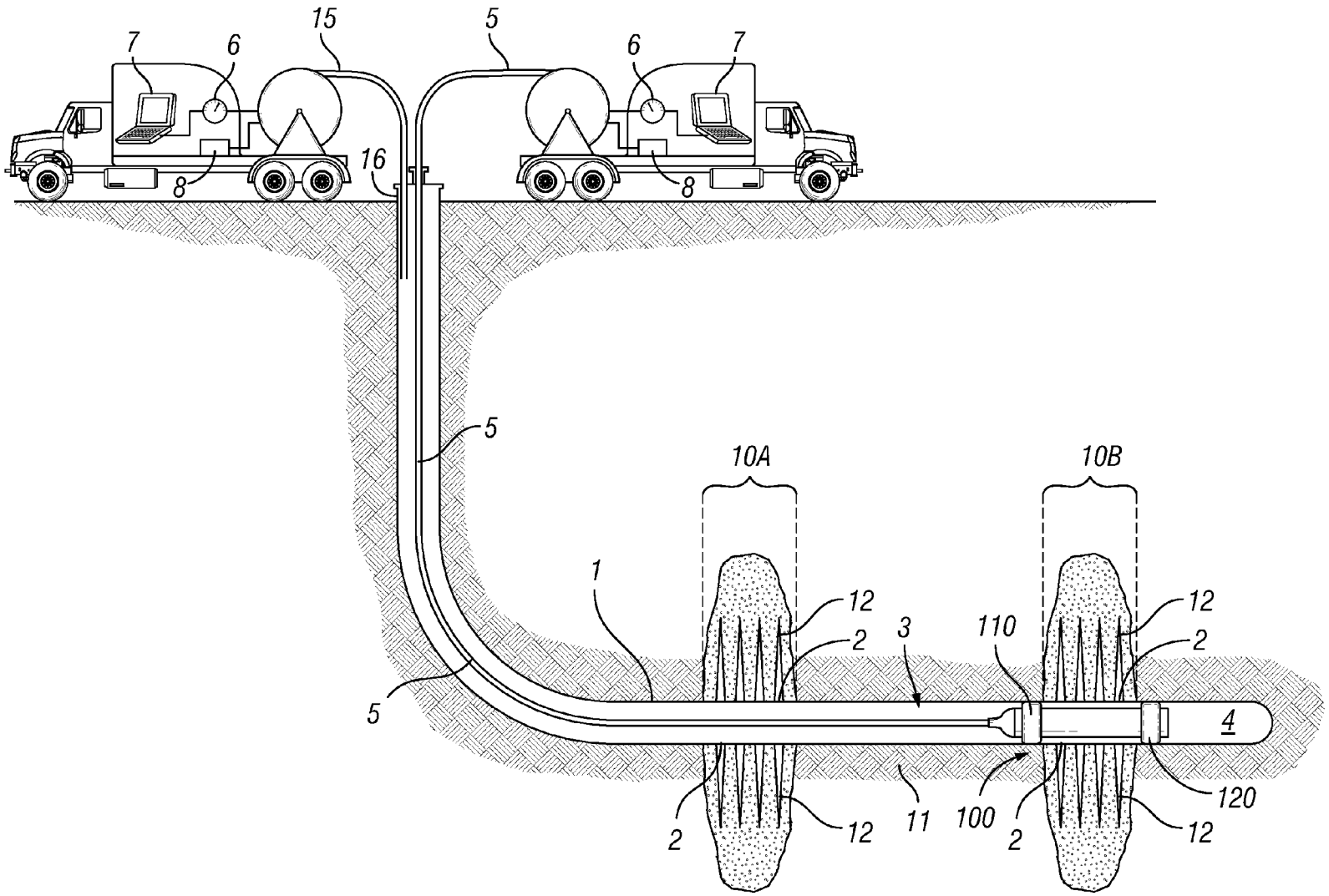
FIG. 10 shows an embodiment of a system that may be used monitor annulus pressure and/or pressure within an isolated portion of a wellbore for hydraulic fracture diagnostics.

FIG. 10 shows a downhole isolation tool 100 connected to coiled tubing 5 that has been positioned within casing 1 of a high angle wellbore adjacent a second production zone 10B. The downhole isolation tool 100 may have been moved to the second production zone 10B after diagnostic testing have been previously conducted on a first product zone 10A. The isolation elements 110 and 120 may be repeatedly actuated and deactivated so multiple locations along the length of a high angle wellbore may be isolated in sequence to permit diagnostic testing along a multizone high angle wellbore. As discussed above, a sensor 6 and a processor based device 7 may be connected to the coiled tubing 5 and be used to determine various characteristics of the formation 11, fractures 12, and/or reservoir within the formation 11 as discussed herein. The sensor 6 may be a pressure sensor and the determine characteristics may be determined based on monitoring the pressure within the coiled tubing 5.

A second system including a pump 8, pressure sensor 6, and processor based device 7 may be used to monitor and record the pressure within an annulus 16 between the coiled tubing 5 and wellbore 1, as shown in FIG. 10. The pump 8 and pressure sensor 6 may be in communication with the annulus 16 via a second tubing string 15. The end of the second tubing string 15 is positioned within the annulus 16 so that the pressure within the annulus 16 may be monitored, recorded, and analyzed by pressure sensor 6 and processor based device 7. A single processor based device 7 may be used to analyze both sensors 6 connected to the annulus 16 and the coiled tubing 5. The pump 8 may inject a volume of fluid or remove a volume of fluid from the annulus 16 via the second tubing string 15.

A volume of fluid may be injected into the annulus 16 creating a pressure disturbance or differential that may be transmitted through the hydraulically connected reservoir. The pressure at the isolated portion of the wellbore may be monitored via the coiled tubing 5 that is in communication with the isolated portion via the port between packing elements 110 and 120. The pressure can also be monitored in the annulus 16 until the pressure is stabilized. Monitoring the pressure over time provides information concerning characteristics of the formation. This information may provide an indication of the connectivity of the formation. The connectivity of the formation enables an operator to define the effectiveness of a planned fracture/re-fracture procedure. The information provided by monitoring the pressures over time may permit the determination of the risk of back filling with debris of sand in the upper section of the annulus while the fracture or re-fracturing procedure is performed.

Figure 11:
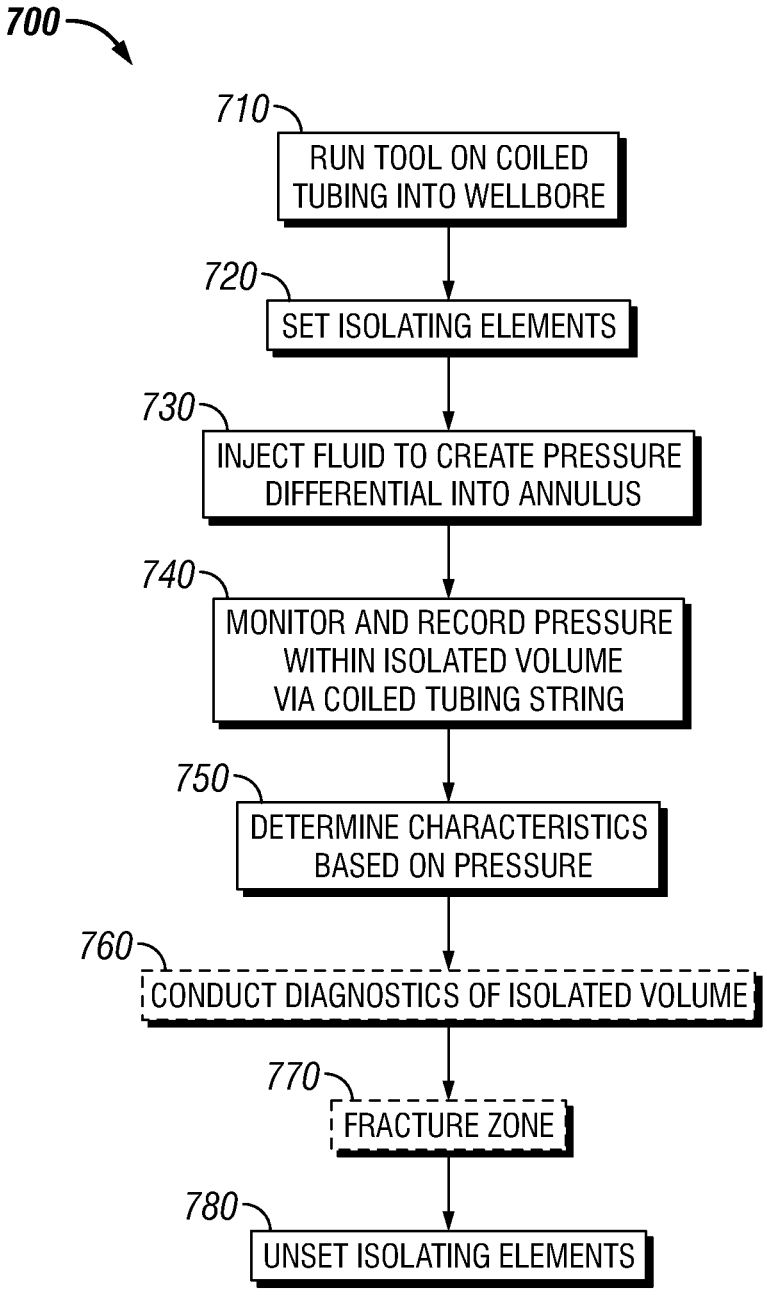
FIG. 11 shows a flow chart of an embodiment of a diagnostic method of injecting fluid into an annulus between a coiled tubing string and the wellbore.

FIG. 11 shows a flow chart of one diagnostic method 700 using a dual isolation tool 100 connected to a first coiled tubing string 5 to isolate and monitor a portion of a wellbore and a second tubing string 15 to inject fluid into an annulus 16. In step 710 of method 700, an isolation tool 100 is run into a high angle wellbore using coiled tubing 5. The coiled tubing 5 is used to locate the tool 100 adjacent a production zone 10 that is to be isolated so that diagnostic testing can be performed. In step 720 of method 700, the isolating elements 110 and 120 of the tool 100 are then set to isolate a portion of the high angle wellbore. In step 730, fluid is injected into an annulus 16 via a pump 8 connected to a second coiled tubing string 15 to create a pressure differential in the annulus 16. The transient fluid pressure within the interior of the coiled tubing 5 and thus, at the isolated portion of the wellbore via the coiled tubing 5 will then be monitored and recorded over time until the pressure has stabilized in step 740. At step 750, the transient pressure may be plotted over time to determine various properties of the wellbore such connectivity of the formation. Optionally at step 760, additional diagnostic testing as discussed herein may be conducted to determine additional information concerning the formation and/or reservoir. The zone may then optionally be fractured, or re-fractured, at step 770. After the diagnostic testing, the isolating elements are unset in step 780 and the tool 100 may be moved to another location within the high angle wellbore via the coiled tubing 5.

Figure 12:
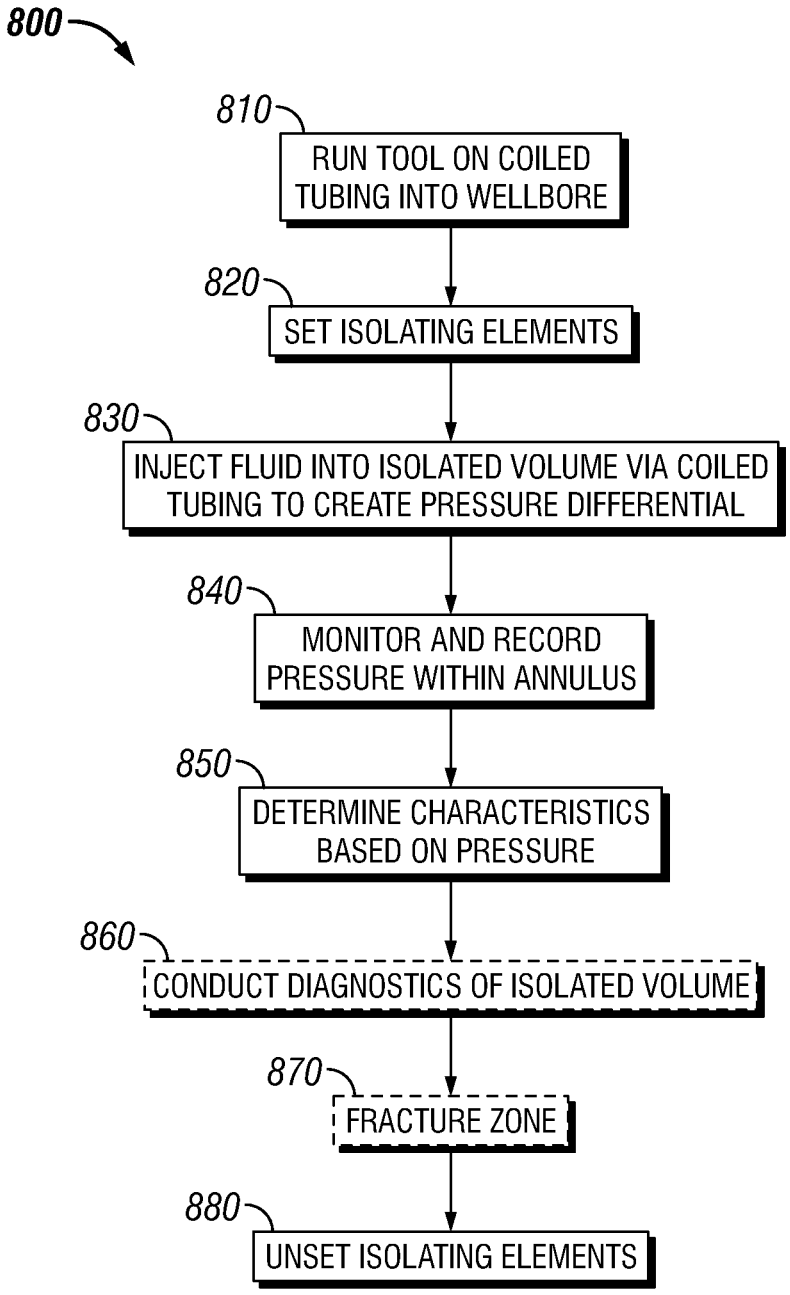
FIG. 12 shows a flow chart of an embodiment of a diagnostic method injecting fluid into an isolated portion of a wellbore via a coiled tubing string and monitoring pressure within an annulus between the coiled tubing string and the wellbore.

FIG. 12 shows a flow chart of one diagnostic method 800 using a dual isolation tool 100 connected to a first coiled tubing string 5 to isolate and monitor a portion of a wellbore and a second tubing string 15 to monitor pressure in an annulus 16 between the coiled tubing 5 and wellbore 1. In step 810 of method 800, an isolation tool 100 is run into a high angle wellbore using coiled tubing 5. The coiled tubing 5 is used to locate the tool 100 adjacent a production zone 10 that is to be isolated so that diagnostic testing can be performed. In step 820 of method 800, the isolating elements 110 and 120 of the tool 100 are then set to isolate a portion of the high angle wellbore. In step 830, a volume of fluid is injected into the isolated portion of the wellbore via a pump 8 connected to the coiled tubing 5. The transient fluid pressure within the annulus 16 will then be monitored and recorded over time until the pressure has stabilized in step 840. At step 850, the transient pressure may be plotted over time to determine various properties of the wellbore such connectivity of the formation. Optionally at step 860, additional diagnostic testing as discussed herein may be conducted to determine additional information concerning the formation and/or reservoir. The zone may then optionally be fractured, or re-fractured, at step 870. After the diagnostic testing, the isolating elements are unset in step 880 and the tool 100 may be moved to another location within the high angle wellbore via the coiled tubing 5

Although this invention has been described in terms of certain preferred embodiments, other embodiments that are apparent to those of ordinary skill in the art, including embodiments that do not provide all of the features and advantages set forth herein, are also within the scope of this invention. Accordingly, the scope of the present invention is defined only by reference to the appended claims and equivalents thereof.

What is claimed is:

1. A hydraulic fracture diagnostic system for well reservoir evaluation of a high angle wellbore comprising:

a coiled tubing string extending from a surface location to a downhole location within a wellbore;

at least one sensor in communication with a portion of the coiled tubing string;

at least one pump in communication with the coiled tubing string;

at least one sensor in communication with an annulus between the coiled tubing string and a casing of the wellbore;

at least one pump in communication with the annulus; and a downhole tool connected to the coiled tubing string being positioned adjacent a hydraulic fracture in a formation traversed by the wellbore, the downhole tool comprising:

a first packing element;

a second packing element, wherein the first packing element and second packing element may be actuated to isolate the hydraulic fracture; and a port positioned between the first packing element and the second packing element, the port configured to provide communication to an exterior of the downhole tool with an interior of the coiled tubing string, wherein the at least one sensor in communication with the coiled tubing string and the at least one sensor in communication with the annulus are pressure sensors located at the surface.

2. The hydraulic fracture diagnostic system of claim 1, further comprising at least one processor, wherein the at least one processor is configured to determine at least one characteristic of the formation of the wellbore based on measurements from the pressure sensors.

3. A diagnostic method utilizing a tool having at least two isolation elements run into a wellbore on coiled tubing with the two isolation elements set against casing to isolate a first portion of the wellbore comprising:

pumping fluid into an annulus located at a surface location between the coiled tubing and the casing to create an increase in pressure, the annulus being outside of the isolated first portion of the wellbore;

monitoring a pressure within the isolated first portion of the wellbore via the coiled tubing with a first pressure sensor located at the surface location;

monitoring a pressure within the annulus between the coiled tubing and a casing of the wellbore with a second pressure sensor located at the surface location; and recording a change in pressure and time until the pressure within the coiled tubing string is stabilized.

4. The diagnostic method of claim 3, further comprising determining at least one characteristic of a formation traversed by the wellbore from monitoring the pressure within the isolated first portion of the wellbore.

5. The diagnostic method of claim 4, further comprising unsetting the at least two isolating elements and moving the tool via the coiled tubing to a second location within the wellbore.

6. The diagnostic method of claim 4, further comprising conducting additional diagnostic testing on the first portion of the wellbore.

7. The diagnostic method of claim 6, further comprising determining additional characteristics of the formation traversed by the wellbore from the additional diagnostic testing on the first portion of the wellbore.

8. The diagnostic method of claim 7, further comprising fracturing the formation adjacent the first portion of the wellbore.

9. The diagnostic method of claim 6, wherein conducting additional diagnostic testing further comprises pumping fluid from the isolated first portion of the wellbore via the coiled tubing and monitoring a pressure in the coiled tubing.

10. The diagnostic method of claim 9, wherein conducting additional diagnostic testing further comprises injecting fluid into the isolated first portion of the wellbore via the coiled tubing and monitoring the pressure in the coiled tubing.

11. A diagnostic method of an openhole portion of a high angle wellbore comprising:

running a tool from a surface location to an openhole location in a high angle wellbore, the tool being connected to a coiled tubing string and comprising at least two packing elements and a port between the two packing elements, the port in communication with an interior of the coiled tubing string;

setting the at least two packing elements to hydraulically isolate a portion of the openhole location of the high angle wellbore;

filling and pressurizing the interior of the coiled tubing string with a diagnostic fluid having a known density;

monitoring a pressure within the interior of the coiled tubing string while the coiled tubing is filled with the diagnostic fluid.

* * * * *